US009318054B2

(12) United States Patent
Lee et al.

(10) Patent No.: US 9,318,054 B2
(45) Date of Patent: Apr. 19, 2016

(54) ORGANIC LIGHT EMITTING DIODE DISPLAY DEVICE FOR IMPROVING INITIALIZATION CHARACTERISTICS AND METHOD OF DRIVING THE SAME

(71) Applicant: LG Display Co., Ltd., Seoul (KR)

(72) Inventors: Jung-Min Lee, Pyeongtaek-si (KR); Jae-Ho Sim, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 184 days.

(21) Appl. No.: 13/692,756

(22) Filed: Dec. 3, 2012

(65) Prior Publication Data

US 2013/0141316 A1 Jun. 6, 2013

(30) Foreign Application Priority Data

Dec. 5, 2011 (KR) ..... 10-2011-0128917

(51) Int. Cl.
*G09G 3/30* (2006.01)
*G09G 3/32* (2006.01)

(52) U.S. Cl.
CPC ..... *G09G 3/3266* (2013.01); *G09G 3/3233* (2013.01); *G09G 2300/0819* (2013.01); *G09G 2300/0842* (2013.01); *G09G 2300/0852* (2013.01); *G09G 2300/0861* (2013.01); *G09G 2310/0256* (2013.01); *G09G 2310/0264* (2013.01); *G09G 2320/043* (2013.01); *G09G 2320/045* (2013.01)

(58) Field of Classification Search
CPC ..... G09G 2300/0819; G09G 2300/0842; G09G 2300/0852; G09G 2300/0861; G09G 2310/0264; G09G 2320/043; G09G 2320/045; G09G 3/3233; G09G 3/3266
USPC ..... 345/76–77
See application file for complete search history.

(56) References Cited

U.S. PATENT DOCUMENTS

| | | | |
|---|---|---|---|
| 8,120,556 | B2 | 2/2012 | Kim |
| 8,289,313 | B2 | 10/2012 | Lee et al. |
| 2006/0033449 | A1 | 2/2006 | Huh |

(Continued)

FOREIGN PATENT DOCUMENTS

| | | | |
|---|---|---|---|
| CN | 1735293 | A | 2/2006 |
| CN | 101231821 | A | 7/2008 |

(Continued)

OTHER PUBLICATIONS

Chinese First Office Action, Chinese Application No. 201210479084.2, Jul. 22, 2014, 18 pages.
European Patent Office, Extended European Search Report and Opinion, European Patent Application No. 12007782.1, Apr. 16, 2013, seven pages.

(Continued)

*Primary Examiner* — Long D Pham
(74) *Attorney, Agent, or Firm* — Fenwick & West LLP

(57) ABSTRACT

An organic light emitting diode (OLED) display device and a method of driving the same are provided. A time point at which each of transistors is turned on is controlled without using an additional transistor so that a node connected to a source electrode of a driver transistor can be floated, and a node connected to a gate electrode of the driver transistor can be initialized to an initialization voltage level. Thus, initialization characteristics can be improved to enhance degradation of response characteristics and luminance, and a threshold voltage of the driver transistor and occurrence of a ripple at a high-potential voltage terminal can be compensated.

27 Claims, 14 Drawing Sheets

(56) References Cited

U.S. PATENT DOCUMENTS

| | | | | |
|---|---|---|---|---|
| 2008/0150846 | A1 | 6/2008 | Chung | |
| 2008/0169754 | A1* | 7/2008 | Yang et al. | 313/504 |
| 2009/0108763 | A1* | 4/2009 | Han et al. | 315/169.3 |
| 2009/0219232 | A1* | 9/2009 | Choi | G09G 3/3233 345/76 |
| 2010/0164847 | A1 | 7/2010 | Lee et al. | |
| 2012/0001893 | A1* | 1/2012 | Jeong | G09G 3/3233 345/213 |
| 2012/0199854 | A1* | 8/2012 | Noguchi | H01L 27/3276 257/88 |

FOREIGN PATENT DOCUMENTS

| | | | |
|---|---|---|---|
| CN | 101256737 | A | 9/2008 |
| JP | 2008-158477 | A | 7/2008 |
| JP | 2009-276744 | A | 11/2009 |
| WO | WO 2011/013409 | | 2/2011 |

OTHER PUBLICATIONS

Japanese Patent Office, Office Action, Japanese Patent Application No. 2012-266236, Dec. 17, 2013, eight pages.

* cited by examiner

ORGANIC LIGHT EMITTING DIODE DISPLAY DEVICE FOR IMPROVING INITIALIZATION CHARACTERISTICS AND METHOD OF DRIVING THE SAME

CROSS-REFERENCE TO RELATED APPLICATIONS

The present application claims benefit of priority to Korean Patent Application No. 10-2011-0128917 filed on Dec. 5, 2011, which is incorporated by reference herein in its entirety.

BACKGROUND

1. Field of the Disclosure

The present disclosure relates to an organic light emitting diode (OLED) display device and a method of driving the same, and more particularly, to an OLED display device and a method of driving the same, which may improve initialization characteristics to enhance response characteristics and solve luminance degradation.

2. Discussion of the Related Art

In recent years, as the information age has progressed, various needs for display fields have increased. To meet those needs, research has been conducted into various flat panel display (FPD) devices that are fabricated to be ultrathin and lightweight and consume low power, for example, liquid crystal display (LCD) devices, plasma display panel (PDP) devices, and organic light emitting diode (OLED) devices.

An OLED display device is an emissive display including organic compounds formed on a transparent substrate to emit red (R), green (G), and blue (B) light. In general, the OLED display device may include an OLED panel and a driver circuit.

Thus, the OLED display device does not require an additional light source unlike an LCD device.

As a result, since a backlight unit (BLU) is not required, the OLED display device may be fabricated using a simpler process at lower fabrication cost than the LCD device, and has attracted much attention as an advanced FPD.

Furthermore, the OLED display device may have a wider viewing angle and a higher contrast ratio than the LCD device, may be driven at a low direct-current (DC) voltage, have a high response speed, and be highly resistant to external shock and applicable within a wide temperature range.

In particular, in an active-matrix-type OLED (AMOLED) display device, a voltage for controlling current applied to a pixel region may be charged in a storage capacitor so that the voltage can be maintained until the next frame signal is applied. Thus, the AMOLED display device may be driven to maintain an emission state during display of one screen irrespective of the number of gate lines.

Accordingly, since the AMOLED display device exhibits the same luminance even with application of a low current, the AMOLED display device may reduce power consumption and be scaled up.

FIG. 1 is a schematic equivalent circuit diagram of a pixel region of a conventional OLED display device.

As shown in FIG. 1, in the conventional OLED display device, a gate line GL and a data line DL may be formed across each other to define a pixel region P, which may include a switching transistor Tsw, a driver transistor Tdr, a storage capacitor Cst, and an OLED.

The switching transistor Tsw may be connected to the gate line GL, the data line DL, and one end of the storage capacitor Cst.

In addition, the driver transistor Tdr may be connected to one end of the storage capacitor Cst, the OLED, and the other end of the storage capacitor Cst.

In this case, the OLED and the driver transistor Tdr may be connected between a high-potential voltage line VDD and a low-potential voltage line VSS.

The operation of the pixel region of the OLED display device will now be described. To begin with, when the switching transistor Tsw is turned on by supplying a gate signal through the gate line GL, a data signal applied through the data line DL may be transmitted to the driver transistor Tdr and the storage capacitor Cst.

Also, when the driver transistor Tdr is turned on in response to the data signal, current may flow through the OLED so that the OLED can emit light.

In this case, intensity of light emitted by the OLED may be proportional to the amount of current flowing through the OLED, which may be proportional to the magnitude of the data signal.

Accordingly, the OLED display device may apply a data signal having various magnitudes to the respective pixel regions P to produce various grayscales. As a result, the OLED display can display images.

Furthermore, the storage capacitor Cst may maintain the data signal during one frame so that the amount of current flowing through the OLED can be maintained constant, and a grayscale displayed by the OLED can be maintained constant.

Meanwhile, unlike a liquid crystal display (LCD) in which a transistor of a pixel region is turned on for only a relatively short time during one frame, in the OLED display device, the driver transistor Tdr may remain turned on for a relatively long time for which the OLED emits light to display a grayscale, so that the driver transistor Tdr can easily deteriorate.

As a result, a threshold voltage Vth of the driver transistor Tdr may vary. Variation in the threshold voltage Vth of the driver transistor Tdr may adversely affect the resolution of the OLED display device.

That is, the pixel region of the OLED display device may display different grayscales in response to the same data signal due to the variation in the threshold voltage Vth of the driver transistor Tdr, thereby exacerbating the resolution of the OLED display device.

Therefore, it is necessary to develop a new pixel structure of an OLED display device to compensate for a variation in threshold voltage caused by deterioration of a driver transistor.

SUMMARY OF THE INVENTION

Accordingly, the present invention is directed to an organic light emitting diode (OLED) display device and a method of driving the same that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, an OLED display device includes: a first transistor connected to a high-potential voltage terminal and a second node; a switching transistor connected to a data line and the second node; a second transistor connected to a drain electrode of a driver transistor and a first node; an emission control transistor connected to the drain electrode of the driver transistor and one electrode of an OLED; a third transistor connected to the one electrode of the OLED and configured to reduce a voltage applied to the one electrode of the OLED; and a first capacitor connected between the high-potential voltage terminal and the first node.

In another aspect, a method of driving an OLED display device including a switching transistor, a driver transistor, an emission control transistor, first through third transistors, first and second capacitors, and an OLED, the method includes: initializing a first node to which a gate electrode of the driver transistor is connected, during turn-on operations of the second and third transistors and the emission control transistor; sensing a threshold voltage of the driver transistor, and transmitting a data voltage to the first node during turn-on operations of the switching transistor and the second and third transistors; and allowing the OLED to emit light during a turn-on operation of the emission control transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 1:
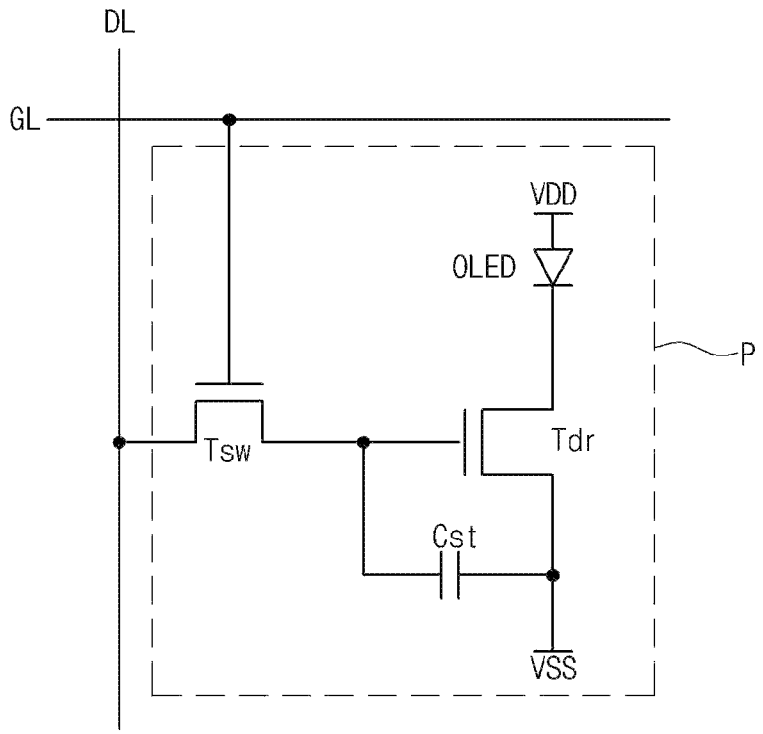
PRIOR ART FIG. 1
FIG. 1 is a schematic equivalent circuit diagram of a pixel region of a conventional organic light emitting diode (OLED) display device.
Figure 2:
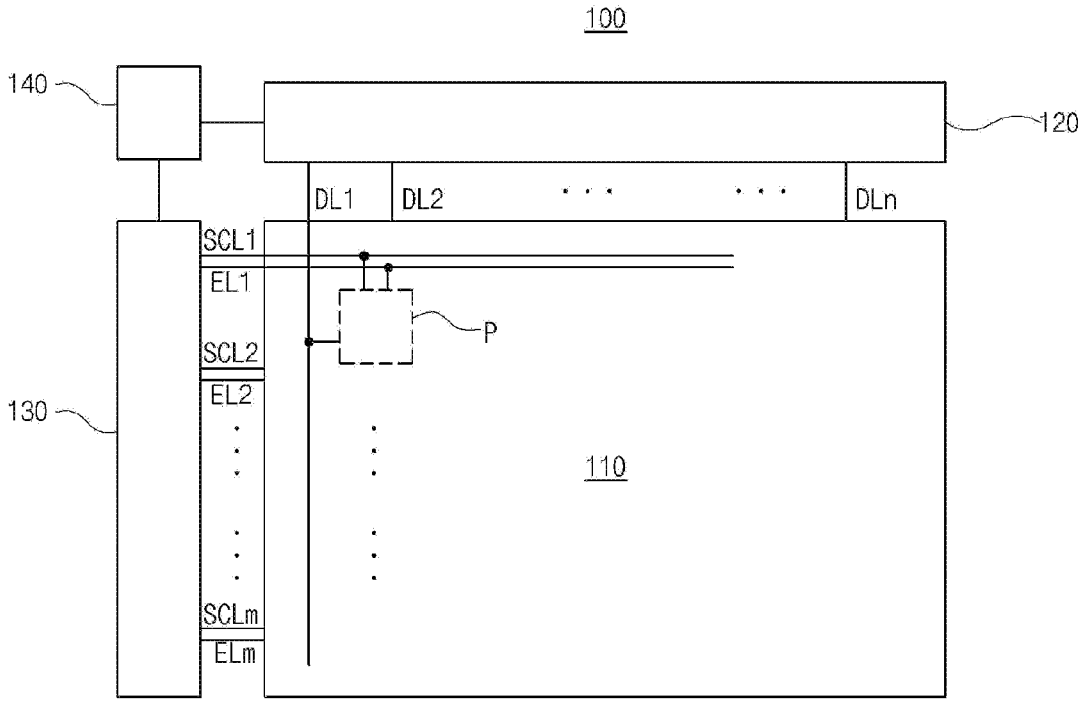
FIG. 2 is a schematic diagram of an OLED display device according to an embodiment of the present invention.
Figure 3:
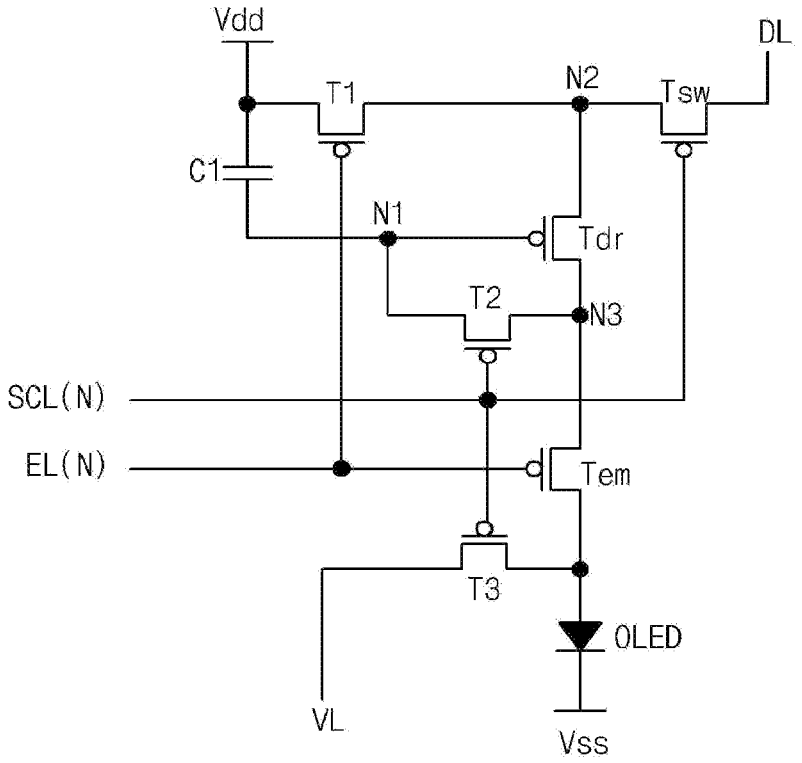
FIG. 3 is a schematic equivalent circuit diagram of a pixel region of an OLED display device according to a first embodiment of the present invention.

FIG. 2 is a schematic diagram of an organic light emitting diode (OLED) display device according to an embodiment of the present invention, and FIG. 3 is a schematic equivalent circuit diagram of an OLED display device according to a first embodiment of the present invention.

As shown in FIG. 2, an OLED display device 100 according to the present invention may include a display panel 110 configured to display images, a source driver 120, a scan driver 130, and a timing controller 140 configured to control a driving time point of each of the source driver 120 and the scan driver 130.

The display panel 110 may include a plurality of scan lines SCL1 to SCLm and a plurality of data lines DL1 to DLn, which may intersect one another to define a plurality of pixel regions P, and a plurality of emission control lines EL1 to ELm.

Since the respective pixel regions P have the same configuration, the plurality of scan lines SCL1 to SCLm, the plurality of data lines DL1 to DLn, and the plurality of emission control lines EL1 to ELm will be respectively described as scan lines SCL, data lines DL, and emission control lines EL for brevity.

As shown in FIG. 3, a switching transistor Tsw, a driver transistor Tdr, an emission control transistor Tem, first through third transistors T1 to T3, a first capacitor C1, and an OLED may be formed in each of the pixel regions P.

Although FIG. 3 shows an example in which the switching transistor Tsw, the driver transistor Tdr, the emission control transistor Tem, and the first through third transistors T1 to T3 are P-type transistors, the present invention is not limited thereto. For example, the switching transistor Tsw, the driver transistor Tdr, the emission control transistor Tem, and the first through third transistors T1 to T3 may be N-type transistors.

Source and gate electrodes of the switching transistor Tsw may be connected to the data line DL and the scan line SCL, respectively, and a drain electrode of the switching transistor Tsw may be connected to a second node N2.

The switching transistor Tsw may be turned on in response to a scan signal applied through the scan line SCL, and apply a data voltage Vdata to the second node N2.

Source and gate electrodes of the driver transistor Tdr may be connected to the second node N2 and a first node N1, respectively, and a drain electrode of the driver transistor Tdr may be connected to a third node N3.

In other words, the first node N1 may be a node to which the gate electrode of the driver transistor Tdr is connected, the second node N2 may be a node to which the source electrode of the driver transistor Tdr is connected, and the third node N3 may be a node to which the drain electrode of the driver transistor Tdr is connected.

The driver transistor Tdr may serve to control the amount of current flowing through the OLED. The amount of current flowing through the OLED may be proportional to the magnitude of the data voltage Vdata applied to the gate electrode of the driver transistor Tdr.

That is, the OLED display device 100 may apply the data voltage Vdata having various magnitudes to the respective pixel regions P, and display different grayscales to display images.

Source and gate electrodes of the emission control transistor Tem may be connected to the third node N3 and the emission control line EL, respectively, and a drain electrode of the emission control transistor Tem may be connected to one electrode of the OLED.

The emission control transistor Tem may be turned on in response to an emission control signal applied through the emission control line EL, and control an emission time point of the OLED.

Source and gate electrodes of the first transistor T1 may be connected to a terminal of a high-potential voltage Vdd and the emission control line EL, respectively, and a drain electrode of the first transistor T1 may be connected to the second node N2.

The first transistor T1 may be turned on in response to an emission control signal Em applied through the emission control line EL, and apply a high-potential voltage Vdd to the second node N2.

In this case, the high-potential voltage Vdd may be, for example, about 5V.

Source and gate electrodes of the second transistor T2 may be connected to the third node N3 and the scan line SCL, respectively, and a drain electrode of the second transistor T2 may be connected to the first node N1.

The second transistor T2 may be turned on in response to a scan signal applied through the scan line SCL, and initialize the first node N1 to a reference voltage applied through a reference voltage line VL.

Source and gate electrodes of the third transistor T3 may be connected to a drain electrode of the emission control transistor Tem and the scan line SCL, (respectively), and a drain electrode of the third transistor T3 may be connected to the reference voltage line VL.

The third transistor T3 may be turned on in response to the scan signal applied through the scan line SCL, and apply the reference voltage to an anode electrode of the OLED.

Thus, a current path may be formed from the drain electrode of the third transistor T3 to the reference voltage line VL during a turn-on operation of the third transistor T3 so that current flowing into the OLED can be reduced.

The first capacitor C1 may be connected between the first node N1 and the source electrode of the first transistor T1, and store a voltage difference between a voltage of the first node N1 and a voltage applied to the source electrode of the first transistor T1.

The first capacitor C1 may be a storage capacitor, which may maintain a data voltage during one frame so that the amount of current flowing through the OLED can be maintained constant, and a grayscale displayed by the OLED can be maintained constant.

The anode electrode of the OLED may be connected to the drain electrode of the emission control transistor Tem, and a cathode electrode thereof may be connected to a terminal of a low-potential voltage Vss.

In this case, the low-potential voltage Vss may be, for example, −5V.

Referring back to FIG. 2, the source driver 120 may include at least one driver integrated circuit (IC) (not shown) configured to supply the data signal to the display panel 110.

The source driver 120 may receive converted image signals (red/green/blue (R/G/B)) and a plurality of data control signals from the timing controller 140, generate the data signal using the converted image signals (R/G/B) and the plurality of data control signals, and apply the generated signal to the display panel 110 through the data line DL.

The timing controller 140 may receive a plurality of control signals, such as a plurality of image signals, a vertical synchronous signal Vsync, a horizontal synchronous signal Hsync, and a data enable signal DE, through an interface from a system, such as a graphic card.

The timing controller 140 may generate the plurality of data signals, and apply the data signals to respective driver ICs of the source driver 120.

The scan driver 130 may generate the scan signal using the control signal received from the timing controller 140, and supply the generated scan signal through the scan line SCL to the display panel 110.

Furthermore, although FIG. 2 illustrates that the scan driver 130 applies an emission control signal through the emission control line EL to the display panel 110, the present invention is not limited thereto. For example, an additional emission control driver configured to apply the emission control signal may be formed in the OLED display device 100 according to the present invention.

Hereinafter, an operation of the pixel region P of the OLED display device 100 will be described.

Figure 4:
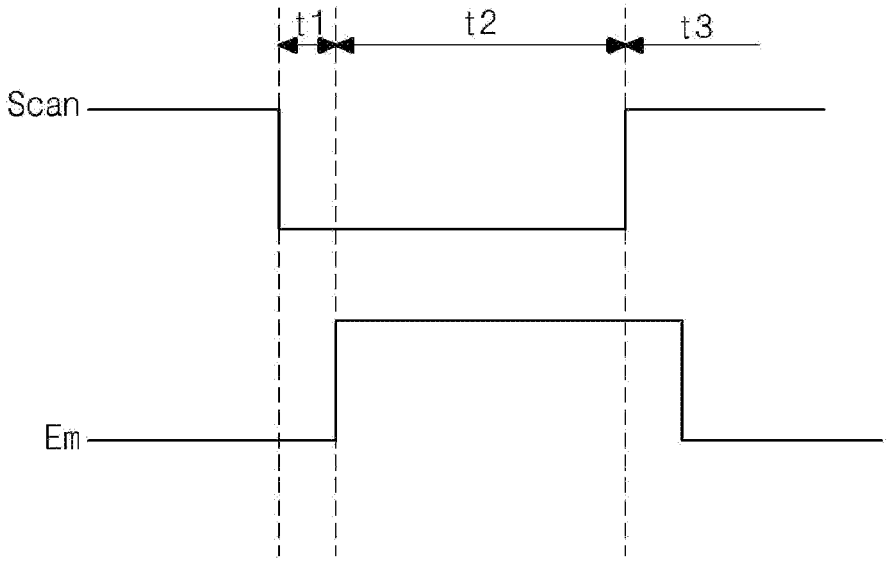
FIG. 4 is a timing diagram of a plurality of control signals applied to the OLED according to the first embodiment of the present invention.
Figure 5:
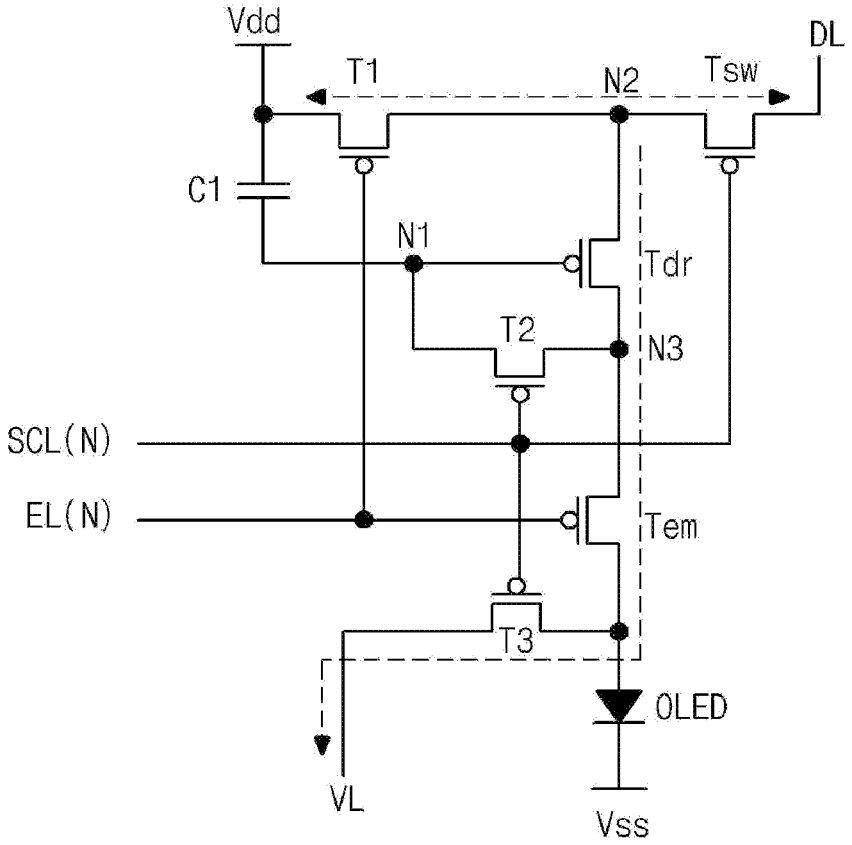
FIG. 5 is a reference diagram for explaining an operation of the pixel region of the OLED display device according to the first embodiment of the present invention.

FIG. 4 is a timing diagram of a plurality of control signals applied to the OLED display device 100 according to the first embodiment of the present invention, and FIG. 5 is a reference diagram for explaining the operation of the pixel region of the OLED display device 100 according to the first embodiment of the present invention.

As shown in FIG. 4, a low-level scan signal Scan and a low-level emission control signal Em may be applied during a first time t1.

In this case, the voltage level of a reference voltage supplied through the reference voltage line VL may be set such that a voltage difference between the reference voltage and the low-potential voltage Vss is lower than the threshold voltage Vth of the OLED.

Here, the threshold voltage Vth of the OLED may be, for example, 2V.

In addition, the voltage level of the reference voltage may be set to be lower than a voltage difference 'Vdata−Vth' between the data voltage Vdata and the threshold voltage Vth of the driver transistor Tdr.

In this case, the reference voltage may be, for example, −4V.

Thus, the switching transistor Tsw and the second and third transistors T2 and T3 may be turned on in response to a low-level scan signal Scan, and the emission control transistor Tem and the first transistor T1 may be turned on in response to the emission control signal Em and initialize the first node N1 to the reference voltage.

In other words, during the first time t1, the switching transistor Tsw, the emission control transistor Tem, and the first through third transistors T1 to T3 may be turned on, and the driver transistor Tdr may also be turned on in response to a data voltage of the previous frame stored in the first capacitor C1.

As the second transistor T2, the emission control transistor Tem, and the third transistor T3 are simultaneously turned on, an initialization current path may be formed from the first node N1 to the reference voltage line VL.

As a result, the first node N1 may be initialized to the reference voltage during the first time t1.

In addition, due to the formation of the initialization current path, current flowing into the OLED may be reduced, thereby preventing the OLED from emitting light.

During the first time t1, a voltage VN1 applied to the first node N1 may be the reference voltage, while a voltage VN2 applied to the second node N2 may be the high-potential voltage Vdd.

A low-level scan signal Scan and a high-level emission control signal Em may be applied during a second time t2.

As a result, the switching transistor Tsw and the second and third transistors T2 and T3 may be turned on in response to a low-level scan signal Scan, and sense the threshold voltage Vth of the driver transistor Tdr.

Furthermore, the data voltage Vdata may be applied to the first node N1 along a sampling/writing current path from the second node N2 to the first node N1, which may be formed by turning on the switching transistor Tsw.

During the second time t2, a voltage VN1 applied to the first node N1 may be 'Vdata−Vth', and a voltage VN2 applied to the second node N2 may be 'Vdata'.

The threshold voltage Vth of the driver transistor Tdr and the data voltage Vdata may be simultaneously stored in the first capacitor C1 during the second time t2.

Here, the emission control transistor Tem and the first transistor T1 may be turned off.

During a third time t3, a high-level scan signal Scan may be applied, and the emission control signal Em may be applied during the high-to-low transition thereof.

As a result, the emission control transistor Tem, the first transistor T1, and the driver transistor Tdr may be turned on, so that an emission current path can be formed from the second node N2 to the OLED. Also, current IOLED may be supplied to the OLED along the emission current path to enable an emission state.

Here, the switching transistor Tsw and the second and third transistors T2 and T3 may remain turned off.

During the third time t3, a voltage VN1 applied to the first node N1 may be 'Vdata−Vth', and a voltage VN2 applied to the second node N2 may be 'Vdd'.

In this case, the current $I_{OLED}$ flowing through the OLED may be defined as in Equation 1:

$$I_{OLED}=k*(Vdd-V\text{data})^2 \quad (1)$$

wherein k is a proportional constant determined by the structure and physical properties of the driver transistor Tdr, for example, the mobility of the driver transistor Tdr and a ratio W/L of a channel width W of the driver transistor Tdr to a channel length L thereof.

As a result, current $I_{OLED}$ supplied to the OLED for the third time t3 may be irrelevant to the threshold voltage Vth of the driver transistor Tdr, and may be determined by the high-potential voltage Vdd and the data voltage Vdata.

Thus, non-uniformity in luminance caused by differences between the characteristics of transistors may be improved.

In the OLED display device according to the first embodiment of the present invention, an initialization period for initializing the first node N1 to a predetermined voltage may be needed so that the driver transistor Tdr cannot be affected by the data voltage of the previous frame due to operating characteristics of a threshold voltage (Vth) compensating circuit of the driver transistor Tdr.

Thus, a pixel structure of the OLED display device according to the first embodiment of the present invention may include the third transistor T3, which may allow current supplied to the OLED to flow into the reference voltage line VL during the first time t1 (an initialization period), and the first node N1 may be initialized to the reference voltage, which is an initialization voltage, during the first time t1.

However, not only the second and third transistors T2 and T3 but also the switching transistor Tsw and the first transistor T1 may remain turned on during the first time t1.

Accordingly, as shown in FIG. 5, first through third current paths may be formed from the second node N2 toward the switching transistor Tsw, the first transistor T1, and the driver transistor Tdr, respectively.

In other words, the first current path may be formed from the second node N2 toward the switching transistor Tsw, the second current path may be formed from the second node N2 toward the first transistor T1, and the third current path may be formed from the second node N2 toward the driver transistor Tdr.

As a result, since a high initialization current flows along an initialization current path from the first node N1 to the reference voltage line VL and the third current path, which are formed during the first time t1, the first node 1 may not be initialized to the reference voltage, which is the initialization voltage.

Also, as the switching transistor Tsw and the first transistor T1 are turned on, an electrical short between the high-potential voltage Vdd and the data voltage Vdata may occur to generate overcurrent.

In an example, a high initialization current may flow along the initialization current path from the first node N1 to the reference voltage line VL and the third current path, which are formed during the first time t1.

In this case, the high-potential voltage Vdd and the low-potential voltage Vss may be 5 V and −5 V, respectively, and the reference voltage may be −4 V.

Also, with application of the high initialization current, voltage division may occur due to on-resistances Ron of the emission control transistor Tem and the third transistor T3.

In this case, a voltage of −2.8 V may be applied to a node connected to an anode electrode of the OLED, and a voltage of −2 V may be applied to each of the first and third nodes N1 and N3.

Accordingly, in the pixel structure of the OLED display device according to the first embodiment of the present invention, the first node N1 cannot be initialized to the reference voltage, which is the initialization voltage, during the initialization period.

As a result, in the pixel structure of the OLED display device according to the first embodiment of the present invention, attained luminance and capability of compensating for a deviation in the threshold voltage Vth of the driver transistor Tdr may depend on the data voltage Vdata.

In particular, attainment of desired luminance and capability of compensating for a deviation in the threshold voltage Vth of the driver transistor Tdr may be degraded at a low data voltage Vdata.

For example, when the data voltage Vdata is about 3V and a threshold voltage Vth of the driver transistor Tdr ranges from about −2 V to about −4 V, grayscale expression and compensation of the threshold voltage Vth may be normally enabled.

In contrast, when the data voltage Vdata is about 1V and the threshold voltage Vth of the driver transistor Tdr is about −3 V or less, grayscale expression and the compensation of the threshold voltage Vth cannot be normally enabled.

That is, when the data voltage Vdata is maintained constant, as the threshold voltage Vth of the driver transistor Tdr decreases, attainment of desired luminance and capability of compensating for a deviation in the threshold voltage Vth of the driver transistor Tdr may further deteriorate.

In addition, when the threshold voltage Vth of the driver transistor Tdr is maintained constant, as the data voltage Vdata decreases, attainment of desired luminance and capability of compensating for a deviation in the threshold voltage Vth of the driver transistor Tdr may further deteriorate.

Accordingly, when the data voltage Vdata or the threshold voltage Vth of the driver transistor is reduced, the voltage level of the reference voltage should be further dropped to normally sample (or sense) the threshold voltage Vth of the driver transistor Tdr.

However, in the pixel structure of the OLED display device according to the first embodiment of the present invention, since overcurrent occurs due to an electrical short between the high-potential voltage Vdd and the data voltage Vdd during the initialization period, even if the voltage level of the reference voltage is further reduced, the first node N1 cannot be initialized to the reference voltage, which is the initialization voltage.

As a result, when the pixel structure of the OLED display device according to the first embodiment of the present invention is applied, there are specific limits to attaining desired luminance and improving capability of compensating for a deviation in the threshold voltage Vth of the driver transistor Tdr.

Figure 6:
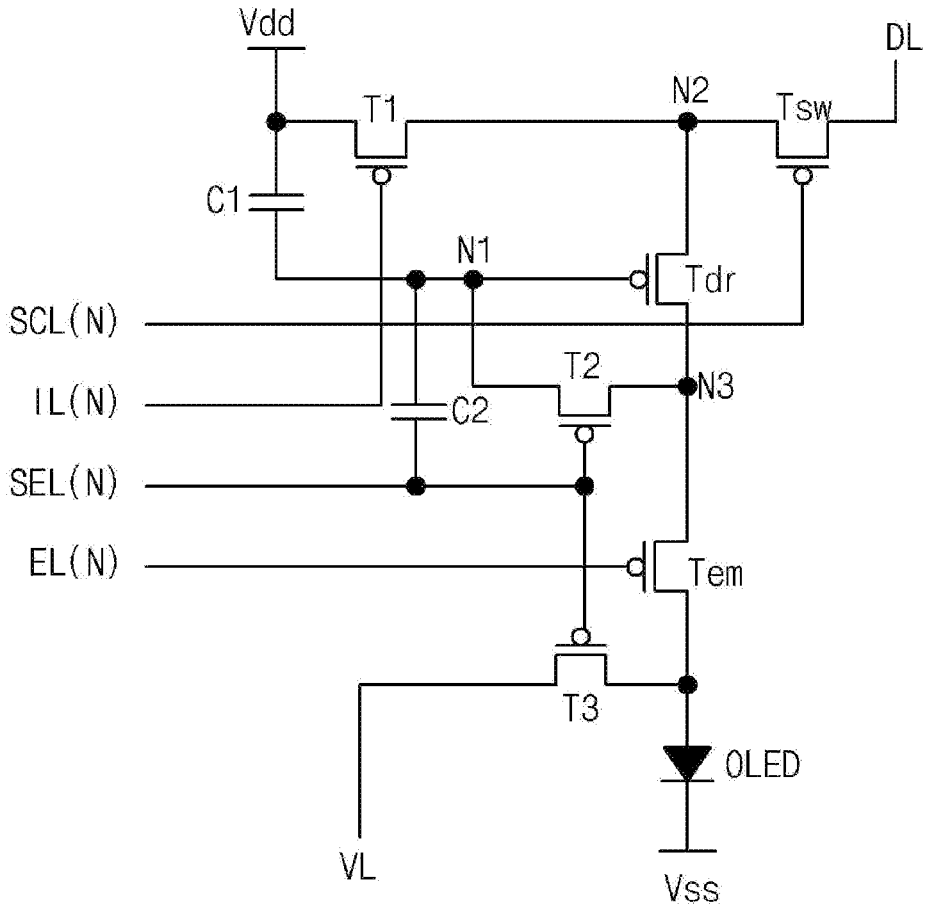
FIG. 6 is a schematic equivalent circuit diagram of a pixel region of an OLED display device according to a second embodiment of the present invention.

FIG. 6 is a schematic equivalent circuit diagram of a pixel region of an OLED display device according to a second embodiment of the present invention. Since some components of the OLED display device according to the second embodiment are substantially the same as in the first embodiment, differences between the first and second embodiments will now be chiefly described.

As shown in FIG. 6, a switching transistor Tsw, a driver transistor Tdr, an emission control transistor Tem, first through third transistors T1 to T3, a first capacitor C1, a second capacitor C2, and an OLED may be formed in each of pixel regions.

In a pixel structure of the OLED display device according to the second embodiment of the present invention, a connection structure among first through third transistors T1 to T3 may be modified.

Source and gate electrodes of the first transistor T1 may be connected to a terminal of a high-potential voltage Vdd and an initialization line IL, respectively, and a drain electrode of the first transistor T1 may be connected to a second node N2.

The first transistor T1 may be turned on in response to an initialization signal applied through the initialization line IL, and apply the high-potential voltage Vdd to the second node N2. In this case, the high-potential voltage Vdd may be, for example, about 5 V.

Source and gate electrodes of the second transistor T2 may be connected to a third node N3 and a sensing line SEL, respectively, and a drain electrode of the second transistor T2 may be connected to a first node N1.

The second transistor T2 may be turned on in response to a sensing signal applied through the sensing line SEL, and apply a reference voltage to the first node N1 to initialize the first node N1.

Source and gate electrodes of the third transistor t3 may be connected to a drain electrode of the emission control transistor Tem and the sensing line SEL, respectively, and a drain electrode of the third transistor T3 may be connected to a reference voltage line VL.

The third transistor T3 may be turned on in response to the sensing signal applied through the sensing line SEL, and apply the reference voltage to an anode electrode of the OLED.

The first capacitor C1 may be connected between the first node N1 and the source electrode of the first transistor T1, and store a voltage difference between a voltage of the first node N1 and a voltage applied to the source electrode of the first transistor T1.

The first capacitor C1 may be a storage capacitor configured to maintain a data voltage during one frame so that the amount of current flowing through the OLED can be maintained constant, and a grayscale displayed by the OLED can be maintained constant.

The second capacitor C2 may be connected between the first node N1 and the sensing line SEL, and store a voltage difference between the voltage of the first node N1 and the sensing signal.

The OLED display device according to the second embodiment of the present invention to which the above-described pixel structure is applied may further include an initialization driver configured to apply an initialization signal, and a sensing driver configured to apply a sensing signal.

That is, in the OLED display device according to the second embodiment of the present invention, control signals of respective transistors may be separated from one another by increasing the number of drivers.

Figure 7:
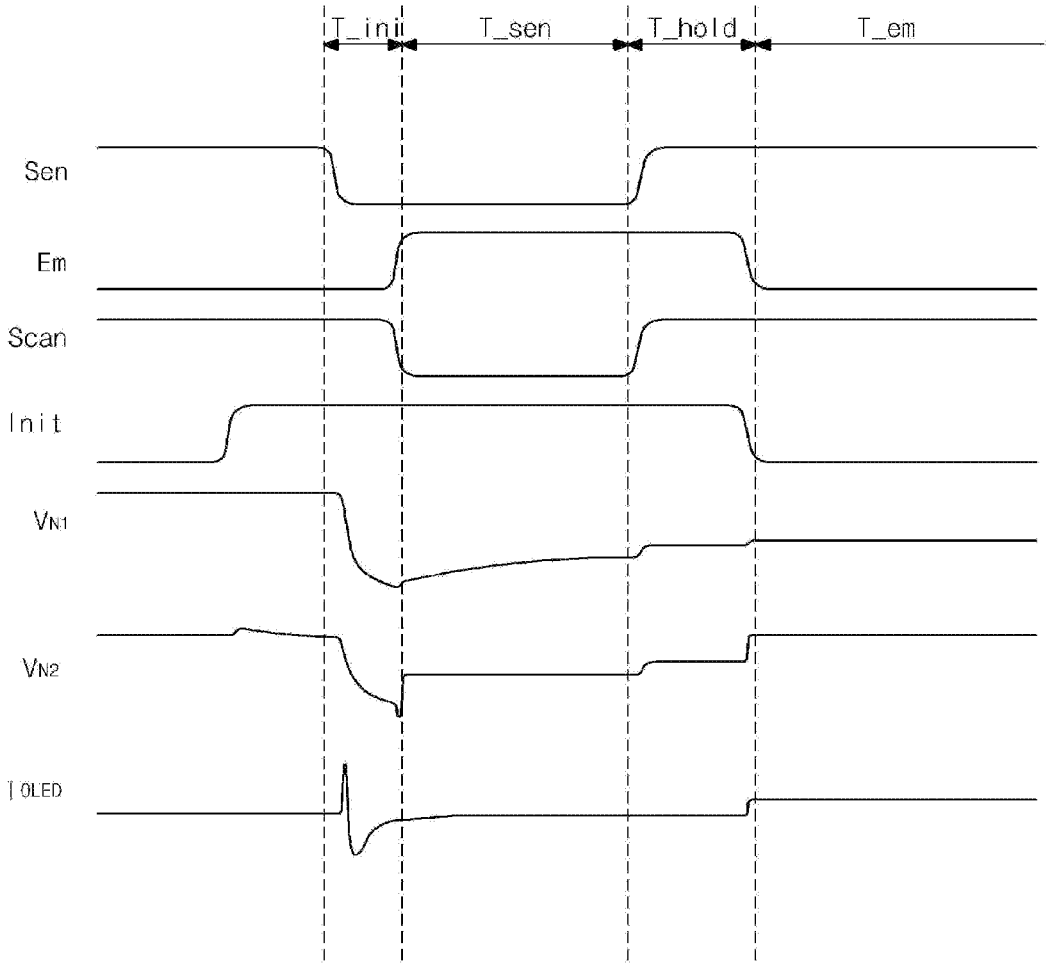
FIG. 7 is a timing diagram of a plurality of control signals applied to the OLED display device according to the second embodiment of the present invention, voltages of first and second nodes, and current flowing through an emission diode.
Figure 8:
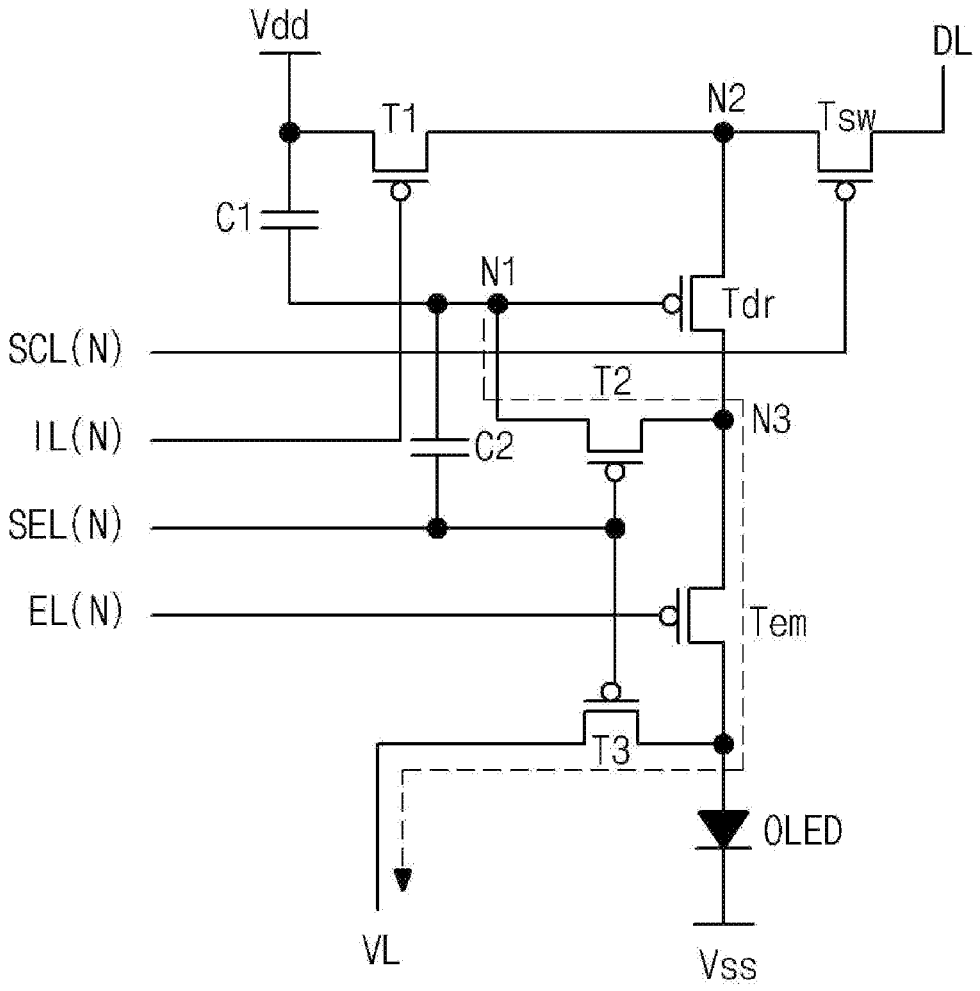
FIG. 8 is a reference diagram for explaining an operation of the pixel region of the OLED display device according to the second embodiment of the present invention.

FIG. 7 is a timing diagram of a plurality of control signals applied to the OLED display device according to the second embodiment of the present invention, voltages of first and second nodes, and current flowing through an emission diode, and FIG. 8 is a reference diagram for explaining an operation of the pixel region of the OLED display device according to the second embodiment of the present invention. Hereinafter, the operation of the pixel region of the OLED display device according to the second embodiment of the present invention will be described with reference to FIGS. 6 through 8.

As shown in FIG. 7, during an initialization time T_ini, a low-level sensing signal Sen and a low-level emission control signal Em may be applied, and a high-level scan signal Scan and an initialization signal Init may be applied.

In this case, the voltage level of a reference voltage applied through the reference voltage line VL may be set such that a voltage difference between the reference voltage and the low-potential voltage Vss is lower than the threshold voltage Vth of the OLED.

Here, the threshold voltage Vth of the OLED may be, for example, about 2V.

In addition, the voltage level of the reference voltage may be set to be lower than a voltage difference between the data voltage Vdata and the threshold voltage Vth of the driver transistor Tdr.

For example, the reference voltage may be about −4 V.

Accordingly, the second and third transistors T2 and T3 and the emission control transistor Tem may be turned on in response to the low-level sensing signal Sen and the low-level emission control signal Em, respectively, so that the first node N1 can be initialized to the reference voltage.

That is, in the pixel structure of the OLED display device according to the second embodiment of the present invention, the switching transistor Tsw and the first transistor T1 may remain turned off during the initialization time T_ini.

As a result, in the pixel structure of the OLED display device according to the second embodiment of the present invention, the flow of overcurrent caused by an electrical short between the high-potential voltage Vdd and the data voltage Vdata may be prevented.

More specifically, as shown in FIG. 8, an initialization current path may be formed from the first node N1 to the reference voltage line VL during the initialization time T_ini.

Also, the switching transistor Tsw and the first transistor T1 may be turned off so that a voltage applied to the second node N2 may be floated and dropped to about −2.4 V.

Thus, current flowing along a third current path formed from the second node N2 toward the driver transistor Tdr may be reduced so that an initialization current flowing along the initialization current path and the third current path can be reduced.

Also, due to the reduction in the initialization current, voltage division caused by on-resistances Ron of the emission control transistor Tem and the third transistor T3 may be reduced.

In this case, when the duration of the initialization time T_ini is sufficient, a voltage of about −3.9 V may be applied to a node connected to an anode electrode of the OLED, and a voltage of about −3.8 V may be applied to the first and second nodes N1 and N3.

Accordingly, in the pixel structure of the OLED display device according to the second embodiment of the present invention, the first node N1 may be initialized to about −3.8 V, which is about equal to the reference voltage corresponding to the initialization voltage, during the initialization time T_ini.

In addition, a voltage of about −3.9 V may be applied to the node connected to the anode electrode of the OLED, so a voltage difference between a voltage of the node connected to the anode electrode of the OLED and the low-potential voltage Vss may become lower than the threshold voltage Vth of the OLED to prevent the OLED from emitting light.

The voltage VN1 applied to the first node N1 during the initialization time T_ini may be the reference voltage, and the voltage VN2 applied to the second node N2 may be the high-potential voltage Vdd.

During a sensing time T_sen, a low-level sensing signal Sen and a high-level emission control signal Em may be applied, and a low-level scan signal Scan and a high-level initialization signal Init may be applied.

As a result, the switching transistor Tsw and the second and third transistors T2 and T3 may be turned on in response to the low-level sensing signal Sen and sense the threshold voltage Vth of the driver transistor Tdr.

Furthermore, a data voltage Vdata may be applied to the first node N1 along a sampling/writing current path from the second node N2 to the first node N1, which is formed by turning on the switching transistor Tsw and the second transistor T2.

The voltage VN1 applied to the first node N1 during the sensing time T_sen may be 'Vdata−Vth' or less to enable a normal sampling (sensing) operation.

Also, the voltage VN2 applied to the second node N2 may be 'Vdata'.

During the sensing time T_sen, the threshold voltage Vth of the driver transistor Tdr and the data voltage Vdata may be simultaneously stored in the first capacitor C1.

Here, the emission control transistor Tem and the first transistor T1 may be in a turn-off state.

During a holding time T_hold, the sensing signal Sen may be applied during the low-to-high transition thereof, the emission control signal Em may be applied during the high-to-low transition, the scan signal Scan may be applied during the low-to-high transition thereof, and the initialization signal Init may be applied during the high-to-low transition thereof.

As a result, states of the switching transistor Tsw, the emission control transistor Tem, and the first through third transistors T1 to T3 may be changed.

More specifically, the switching transistor Tsw may be changed from a turn-on state to a turn-off state, the first transistor T1 may be changed from a turn-off state to a turn-on state, each of the second and third transistors T2 and T3 may be changed from a turn-on state to a turn-off state, and the emission control transistor Tem may be changed from a turn-off state to a turn-on state.

During the holding time T_hold, a sensing signal Sen applied to one end of the second capacitor C2 may make the low-to-high transition.

Thus, a voltage VN1 applied to the first node N1 may rise under the influence of a variation in voltage due to a coupling effect of the second capacitor C2.

Also, during the holding time T_hold, a voltage VN2 applied to the second node N2 may also rise under the influence of a variation in voltage applied to the first node N1.

In this case, in the pixel structure of the OLED display device according to the second embodiment of the present invention, the sum of the initialization time T_ini, the sensing time T_sen, and the holding time T_hold may be one horizontal period 1H.

During the emission time T_em, a high-level sensing signal Sen and a low-level emission control signal Em may be applied, and a high-level scan signal Scan and a low-level initialization signal Init may be applied.

As a result, an emission current path from the second node N2 to the OLED may be formed by turning on the emission control transistor Tem, the first transistor T1, and the driver transistor Tdr, and current $I_{OLED}$ may flow into the OLED along the emission current path to enable an emission state.

Here, the switching transistor Tsw and the second and third transistors T2 and T3 may be in a turn-off state.

During the emission time T_em, the voltage VN1 applied to the first node N1 may be 'Vdata−Vth', and the voltage VN2 applied to the second node N2 may be 'Vdd'.

In this case, current $I_{OLED}$ flowing through the OLED may be defined as in Equation 2:

$$I_{OLED}=0.5*K*(Vdd-V\text{data})^2 \quad (2)$$

wherein k is a proportional constant determined by the structure and physical properties of the structure and physical properties of the driver transistor Tdr, for example, the mobility of the driver transistor Tdr and a ratio W/L of a channel width W of the driver transistor Tdr to a channel length L thereof.

As a result, current $I_{OLED}$ flowing through the OLED during the emission time T_em may be irrespective of the threshold voltage Vth of the driver transistor Tdr and determined by the high-potential voltage Vdd and the data voltage Vdata.

Accordingly, non-uniformity in luminance caused by differences in the characteristics of transistors may be improved.

In the pixel structure of the OLED display device according to the first embodiment of the present invention, a high initialization current may flow along the initialization current path and the third current path during the initialization period.

Also, with application of the high initialization current, voltage division may occur due to on-resistances Ron of the emission control transistor Tem and the third transistor T3, so that the first node N1 cannot be initialized to the reference voltage corresponding to the initialization voltage.

As a result, the pixel structure of the OLED display device according to the first embodiment of the present invention may be affected by the data voltage Vdata of the previous frame because the first node N1 cannot be initialized to the reference voltage.

That is, in the pixel structure of the OLED display device according to the first embodiment of the present invention, luminance may be degraded according to the data voltage Vdata.

In particular, the pixel structure of the OLED display device according to the first embodiment of the present invention cannot reach white luminance for one frame during a black-to-white conversion, thereby degrading response characteristics.

However, in the pixel structure of the OLED display device according to the second embodiment of the present invention, since the switching transistor Tsw and the first transistor T1 are turned off during the initialization time T_ini, an initialization current flowing along the initialization current path and the third current path may be reduced.

Also, since the initialization current is reduced, voltage division due to on-resistances (Ron) of the emission control transistor Tem and the third transistor T3 may be reduced so that the first node N1 can be initialized to about −3.8 V, which is about equal to the reference voltage.

That is, in the pixel structure of the OLED display device according to the second embodiment of the present invention, control signals of respective transistors may be separated by increasing the number of drivers, so that a time point at which each of the transistors is turned on can be controlled to improve initialization characteristics.

As a result, the pixel structure of the OLED display device according to the second embodiment of the present invention may be free from the influence of the data voltage Vdata of the previous frame because the first node N1 may be initialized to the reference voltage.

Thus, the pixel structure of the OLED display device according to the second embodiment of the present invention may improve degradation of response characteristics, luminance degradation, and degradation of capability of compensating for a deviation in the threshold voltage Vth of the driver transistor Tdr.

Figure 9:
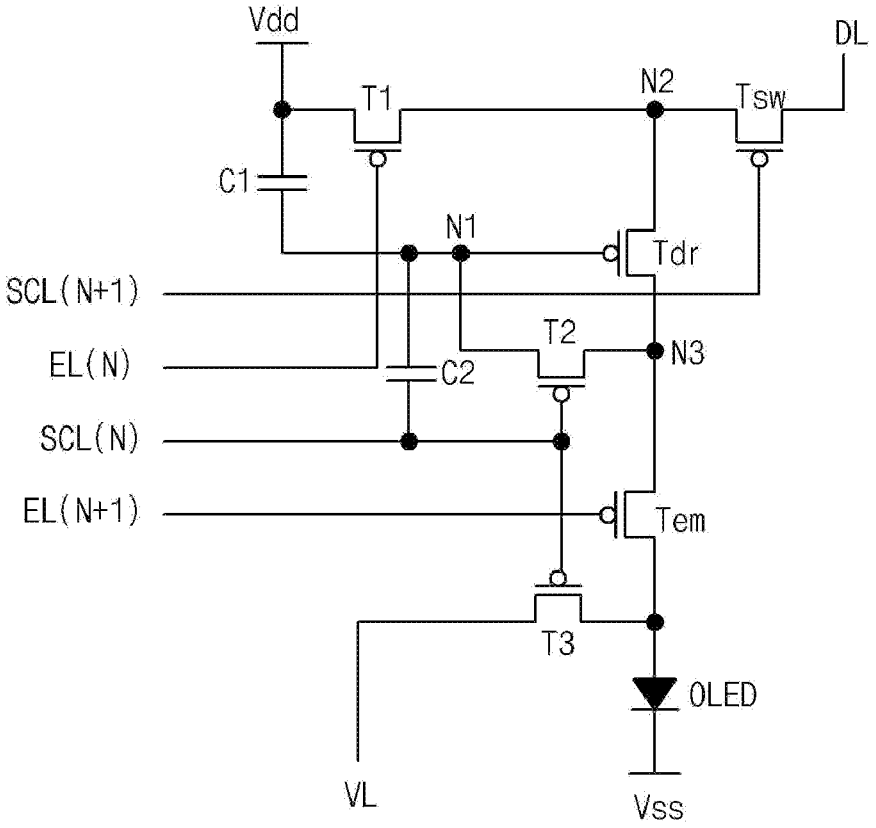
FIG. 9 is a schematic equivalent circuit diagram of a pixel region of an OLED display device according to a third embodiment of the present invention.
Figure 10:
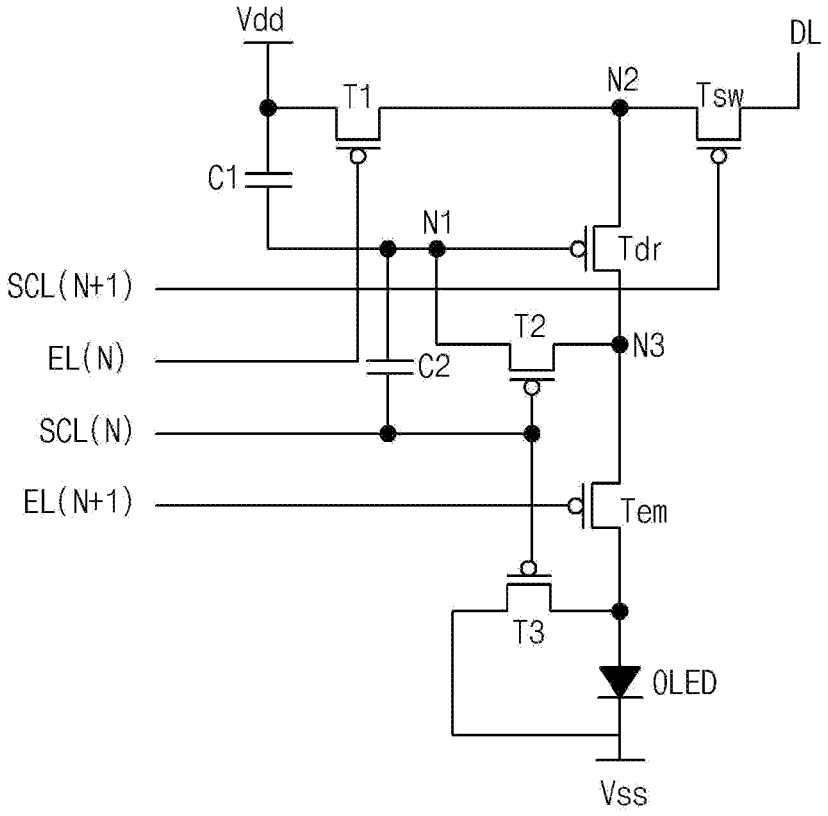
FIG. 10 is a schematic equivalent circuit diagram of a pixel region of an OLED display device according to a fourth embodiment of the present invention.

FIG. 9 is a schematic equivalent circuit diagram of a pixel region of an OLED display device according to a third embodiment of the present invention, and FIG. 10 is a schematic equivalent circuit diagram of a pixel region of an OLED display device according to a fourth embodiment of the present invention.

Referring to FIG. 9, a switching transistor Tsw, a driver transistor Tdr, an emission control transistor Tem, first through third transistor T1 to T3, a first capacitor C1, a second capacitor C2, and an OLED may be formed in each of pixel regions.

In a pixel structure of the OLED display device according to the third embodiment of the present invention, a connection structure among the switching transistor Tsw, the emission control transistor Tem, and the first through third transistors T1 to T3 may be modified.

Source and gate electrodes of the switching transistor Tsw may be connected to a data line DL and an (N+1)th scan line SCL(N+1), respectively, and a drain electrode of the switching transistor Tsw may be connected to a second node N2.

The switching transistor Tsw may be turned on in response to an (N+1)th scan signal applied through the (N+1)th scan line SCL(N+1), and apply a data voltage Vdata to the second node N2.

Source and gate electrodes of the emission control transistor Tem may be connected to a third node N3 and an (N+1)th emission control line EL(N+1), respectively, and a drain electrode of the emission control transistor Tem may be connected to one electrode of the OLED.

The emission control transistor Tem may be turned on in response to an (N+1)th emission control signal applied through the (N+1)th emission control line EL(N+1), and control an emission time point of the OLED.

Source and gate electrodes of the first transistor T1 may be connected to a terminal of a high-potential voltage Vdd and an Nth emission control line EL(N), respectively, and a drain electrode of the first transistor T1 may be connected to the second node N2.

The first transistor T1 may be turned on in response to an Nth emission control signal applied through the Nth emission control line EL(N), and apply the high-potential voltage Vdd to the second node N2. In this case, the high-potential voltage Vdd may be, for example, about 5V.

Source and gate electrodes of the second transistor T2 may be connected to a third node N3 and an Nth scan line SCL(N), respectively, and a drain electrode of the second transistor T2 may be connected to a first node N1.

The second transistor T2 may be turned on in response to an Nth scan signal applied through the Nth scan line SCL(N), and apply a reference voltage to the first node N1 to initialize the first node N1.

Source and gate electrodes of the third transistor T3 may be connected to a drain electrode of the emission control transistor Tem and the Nth scan line SCL(N), respectively, and a drain electrode of the third transistor T3 may be connected to a reference voltage line VL.

The third transistor T3 may be turned on in response to the Nth scan signal applied through the Nth scan line SCL(N), and apply the reference voltage to an anode electrode of the OLED.

In the OLED display device according to the third embodiment of the present invention to which the above-described pixel structure is applied, a time point at which each of the transistors is turned on may be controlled using outputs of a scan driver and an emission control driver without forming an additional driver.

In other words, the OLED display device according to the third embodiment of the present invention may control a time point at which each of the transistors is turned on, using a control signal of the next horizontal line and a control signal of the current horizontal line, thereby improving initialization characteristics.

Since some components of the OLED display device according to the fourth embodiment are substantially the same as in the third embodiment, differences between the third and fourth embodiments will now be chiefly described.

As shown in FIG. 10, a switching transistor Tsw, a driver transistor Tdr, an emission control transistor Tem, first through third transistors T1 to T3, a first capacitor C1, a second capacitor C2, and an OLED may be formed in each of pixel regions.

In a pixel structure of the OLED display device according to the fourth embodiment, a connection structure of the third transistor T3 may be modified.

Source and gate electrodes of the third transistor T3 may be connected to a drain electrode of the emission control transistor Tem and an Nth scan line SCL(N), respectively, and a drain electrode of the third transistor T3 may be connected to a terminal of a low-potential voltage Vss.

The third transistor T3 may be turned on in response to an Nth scan signal applied through the Nth scan line SCL(N), and apply a low-potential voltage Vss to an anode electrode of the OLED.

That is, in the pixel structure of the OLED display device according to the fourth embodiment of the present invention, the drain electrode of the third transistor T3 may be connected to the terminal of the low-potential voltage Vss so that a reference voltage line VL can be eliminated.

Figure 11:
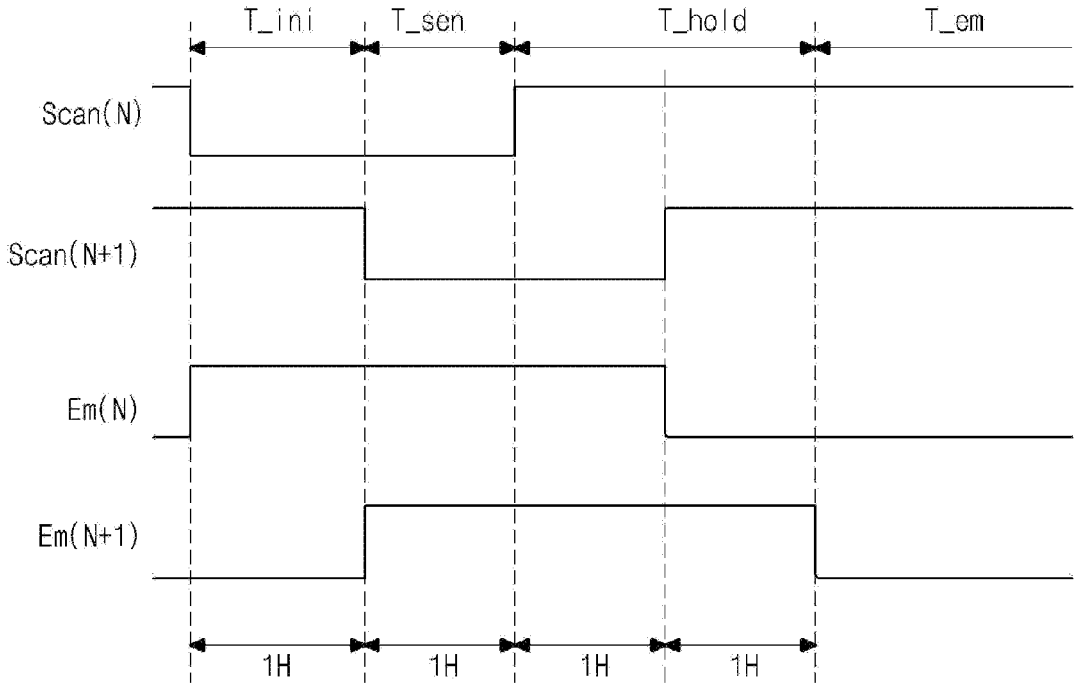
FIG. 11 is a timing diagram of a plurality of control signals applied to the OLED display devices according to the first and fourth embodiments of the present invention.

FIG. 11 is a timing diagram of a plurality of control signals applied to the OLED display devices according to the third and fourth embodiments of the present invention. Hereinafter, operations of the pixel regions of the OLED display devices according to the third and fourth embodiments of the present invention will be described with reference to FIGS. 10 and 11.

Referring to FIG. 11, during an initialization time T_ini, a low-level Nth scan signal Scan(N) and a high-level (N+1)th (N+1)th scan signal Scan(N+1) may be applied, and a high-level Nth emission control signal Em(N) and a low-level (N+1)th(N+1)th emission control signal Em(N+1) may be applied.

In this case, the initialization time T_ini may be one horizontal period 1H.

Here, the reference voltage applied through the reference voltage line VL may have a voltage level of, for example, about −4 V, and the low-potential voltage Vss may have a voltage level of, for example, −5 V.

Accordingly, the second and third transistors T2 and T3 and the emission control transistor Tem may be turned on in response to the low-level Nth scan signal Scan(N) and the (N+1)th(N+1)th emission control signal Em(N+1), respectively, so the first node N1 may be initialized to the reference voltage.

That is, in the pixel structures of the OLED display devices according to the third and fourth embodiments of the present invention, since the switching transistor Tsw and the first transistor T1 remain turned off during the initialization time T_ini, the flow of overcurrent caused by an electrical short between the high-potential voltage Vdd and the data voltage Vdata may be prevented.

During a sensing time T_sen, a low-level Nth scan signal Scan(N) and a low-level (N+1)th(N+1)th scan signal Scan (N+1) may be applied, and a high-level Nth emission control signal Em(N) and a high-level (N+1)th(N+1)th emission control signal Em(N+1) may be applied.

In this case, the sensing time T_sen may be one horizontal period 1H.

As a result, the switching transistor Tsw and the second and third transistors T2 and T3 may be turned on in response to an (N+1)th(N+1)th scan signal Scan(N+1) and a low-level Nth scan signal Scan(N), respectively, and sense the threshold voltage Vth of the driver transistor Tdr.

Also, the data voltage Vdata may be applied to the first node N1 along a sampling/writing current path from the second node N2 to the first node N1, which is formed by turning on the switching transistor Tsw and the second transistor T2.

During the sensing time T_sen, the voltage VN1 applied to the first node N1 may be 'Vdata−Vth' or less to enable a normal sampling (or sensing) operation.

Also, the voltage VN2 applied to the second node N2 may be 'Vdata'.

During the sensing time T_sen, the emission control transistor Tem and the first transistor T1 may be in a turn-off state.

During the holding time T_hold, a high-level Nth scan signal Scan(N) may be applied, an (N+1)th(N+1)th scan signal Scan(N+1) may be applied during the low-to-high transition thereof, an Nth emission control signal Em(N) may be applied during the high-to-low transition thereof, and a high-level (N+1)th emission control signal Em(N+1) may be applied.

In this case, the holding time T_hold may be two horizontal periods 2H.

Thus, the Nth scan signal Scan(N) may be applied at a high level during the two horizontal periods 2H, and the (N+1)th scan signal Scan(N+1) may be applied at a low level during one horizontal period 1H and applied at a high level during one horizontal period 1H.

Also, the Nth emission control signal Em(N) may be applied at high level during one horizontal period 1H and applied at a low level during one horizontal period 1H, and the (N+1)th emission control signal EM(N+1) may be applied at a high level during two horizontal periods 2H.

During a first one horizontal period 1H of the holding time T_hold, the switching transistor Tsw may remain in a turn-on state, the second and third transistors T2 and T3 may be changed from a turn-on state to a turn-off state, and the first transistor T1 and the emission control transistor Tem may remain in a turn-off state.

Thus, since the Nth scan signal Scan(N) applied to one end of the second capacitor C2 makes the low-to-high transition during the first one horizontal period 1H of the holding time T_hold, a voltage VN1 applied to the first node N1 may rise under the influence of a variation in voltage due to a coupling effect of the second capacitor C2.

Next, during a second one horizontal period 1H of the holding time T_hold, the switching transistor Tsw may be changed from a turn-on state to a turn-off state, each of the second and third transistor T2 and T3 and the emission control transistor Tem may remain in a turn-off state, and the first transistor T1 may be changed from a turn-off state to a turn-on state.

Thus, by turning off the switching transistor Tsw and turning on the first transistor T1, the second node N2 may be affected by a variation in voltage of the first node N1.

Accordingly, during the second one horizontal period 1H of the holding time T_hold, the voltage VN2 applied to the second node N2 may rise and finally reach 'Vdd'.

During an emission time T_em, a high-level Nth scan signal Scan(N) and a high-level (N+1)th scan signal Scan(N+1) may be applied, and a low-level Nth emission control signal Em(N) and a low-level (N+1)th emission control signal Em(N+1) may be applied.

As a result, by turning on the emission control transistor Tem, the first transistor T1, and the driver transistor Tdr, an emission current path from the second node N2 to the OLED may be formed, and current $I_{OLED}$ may flow into the OLED along the emission current path to enable an emission state.

Here, the switching transistor Tsw and the second and third transistors T2 and T3 may be in a turn-off state.

Meanwhile, as shown in FIG. 11, the Nth scan signal Scan (N) and the (N+1)th scan signal Scan(N+1) may be controlled to overlap each other during one horizontal period 1H.

Also, the Nth emission control signal Em(N) and the (N+1) th emission control signal Em(N+1) may be controlled to overlap each other during two horizontal periods 2H.

As a result, in the OLED display devices according to the third and fourth embodiments of the present invention, a time point at which each of the transistors is turned on may be controlled using the outputs of a scan driver and an emission control driver without forming an additional driver.

Figure 12A:
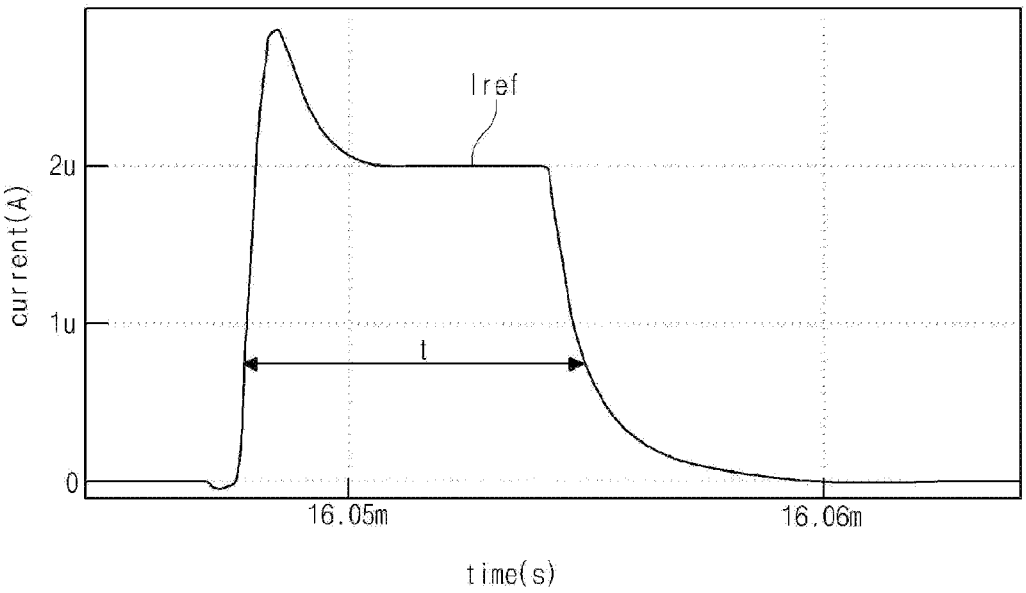
FIGS. 12A and 12B are reference diagrams for explaining initialization characteristics of the OLED display device according to the first embodiment of the present invention.
Figure 12B:
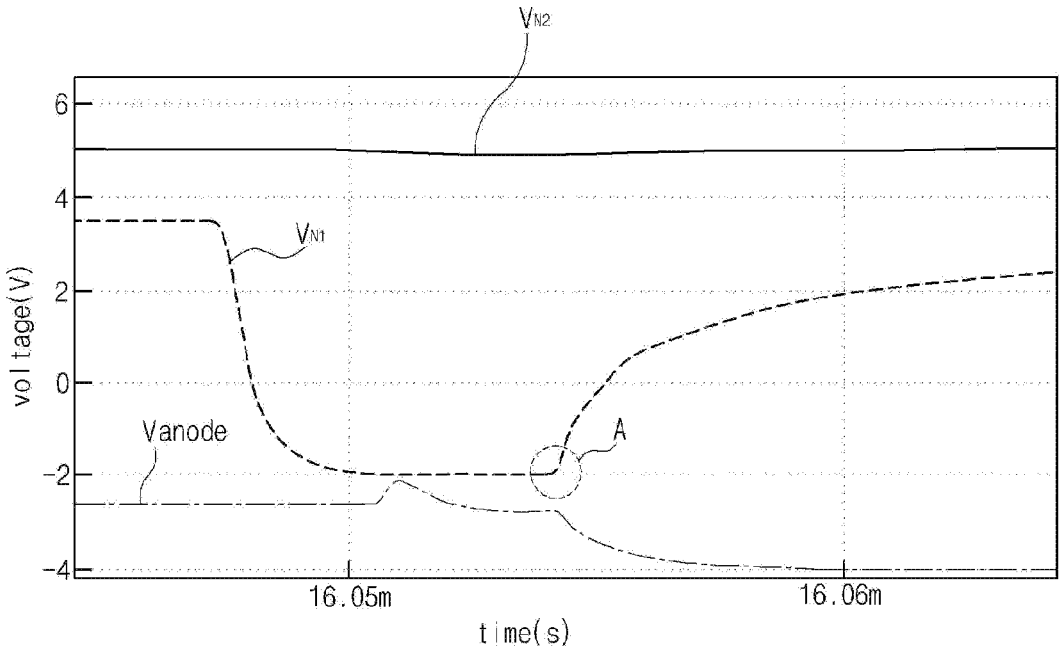
Figure 13A:
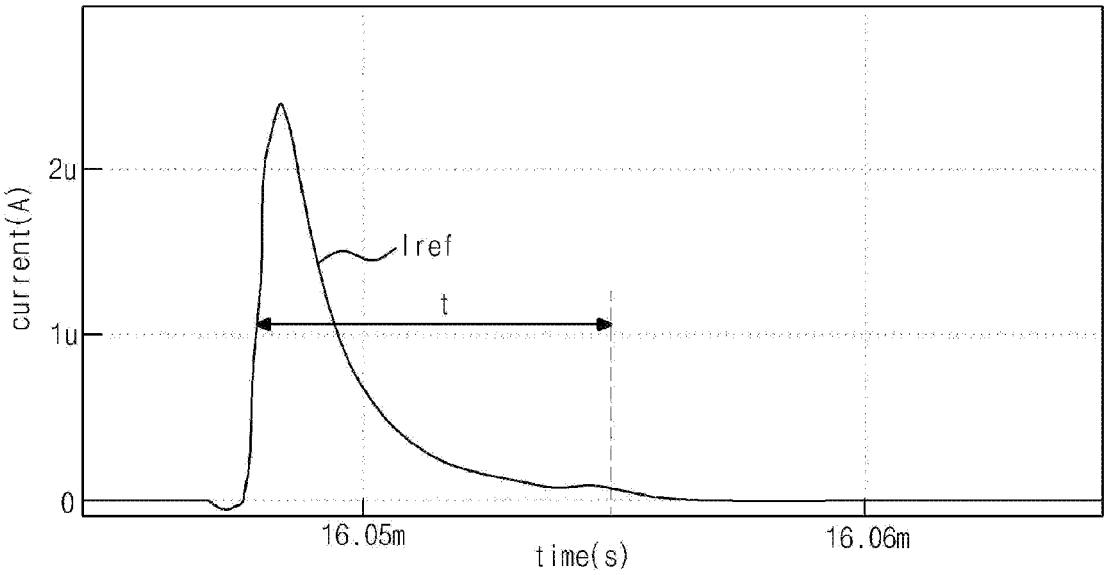
FIGS. 13A and 13B are reference diagrams for explaining initialization characteristics of the OLED display device according to the second embodiment of the present invention.
Figure 13B:
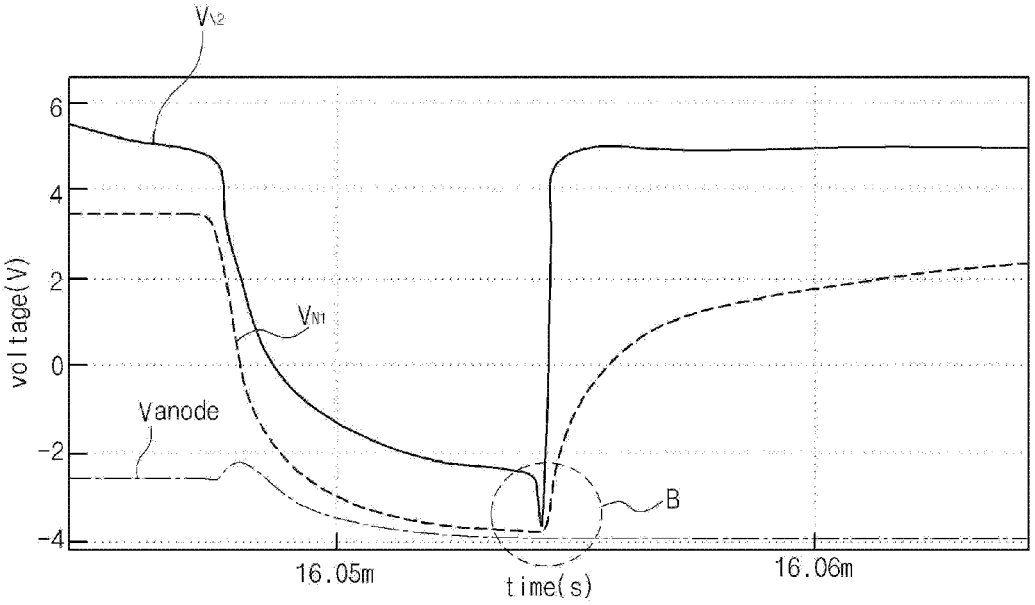

FIGS. 12A and 12B are reference diagrams for explaining initialization characteristics of the OLED display device according to the first embodiment of the present invention, and FIGS. 13A and 13B are reference diagrams for explaining initialization characteristics of the OLED display device according to the second embodiment of the present invention.

As shown in FIG. 12A, in the pixel structure of the OLED display device according to the first embodiment of the present invention, an initialization current Iref of about 2 μm is maintained during an initialization time t.

In this case, the initialization time t may be about 6 μs.

As a result, as shown in FIG. 12B, a voltage VN1 applied to the first node N1 during the initialization time t is about −2V, which is higher than an initialization voltage of about −4 V (refer to portion A).

That is, in the OLED display device according to the first embodiment of the present invention, since a relatively high initialization current Iref flows through an initialization current path during the initialization time t, the first node N1 cannot be initialized to the initialization voltage.

In contrast, as shown in FIG. 13A, in the pixel structure of the OLED display device according to the second embodiment of the present invention, the initialization current Iref reaches a peak value and sharply drops during the initialization time t.

As a result, as shown in FIG. 13B, a voltage VN1 applied to the first node N1 during the initialization time t descends and finally reaches an initialization voltage of about −4 V (refer to portion B).

Accordingly, in the OLED display device according to the second embodiment of the present invention, since a low initialization current Iref flows through an initialization current path during the initialization time t, the first node N1 may be initialized to the initialization voltage.

Although not shown, the pixel structures of the OLED display devices according to the third and fourth embodiments of the present invention can obtain the same effects as in the second embodiment.

As explained thus far, in the OLED display devices according to the second through fourth embodiments of the present invention, a time point at which each of transistors is turned on may be controlled without using an additional transistor so that a node connected to a source electrode of a driver transistor can be floated during an initialization time, and a node connected to a gate electrode of the driver transistor can be initialized to an initialization voltage level.

As a result, degradation of response characteristics, luminance degradation, and degradation of capability of compensating for a deviation in the threshold voltage of the driver transistor can be improved.

Furthermore, when a touch screen panel is applied to the OLED display devices, touch noise can be improved.

As described above, in an OLED display device and a method of driving the same according to the present invention, a time point at which each of transistors is turned on may be controlled without using an additional transistor so that a node connected to a source electrode of a driver transistor can be floated during an initialization time, and a node connected to a gate electrode of the driver transistor can be initialized to an initialization voltage level.

As a result, degradation of response characteristics and luminance degradation can be enhanced, and a threshold voltage of a driver transistor and occurrence of a ripple at a high-potential voltage terminal can be compensated.

Furthermore, since a high initialization current generated during the initialization time can be reduced and a long initialization time can be applied, a reduction in contrast ratio and a rise in power consumption can be inhibited.

In addition, when a touch screen panel is applied to an OLED display device according to the present invention, touch noise can be improved.

It will be apparent to those skilled in the art that various modifications and variations can be made in a display device of the present disclosure without departing from the spirit or scope of the invention. Thus, it is intended that the present invention covers the modifications and variations of this invention provided they come within the scope of the appended claims and their equivalents.

What is claimed is:

1. An organic light emitting diode (OLED) display device comprising:

a first transistor connected to a high-potential voltage terminal and a second node;

a switching transistor connected to a data line and the second node;

a second transistor directly connected to a drain electrode of a driver transistor and a first node;

an emission control transistor connected to the drain electrode of the driver transistor and one electrode of an OLED;

a third transistor connected to the one electrode of the OLED and configured to reduce a voltage applied to the one electrode of the OLED; and a first capacitor connected between the high-potential voltage terminal and the first node, wherein the second transistor and the third transistor simultaneously turn on in response to a sensing signal applied through a sensing line and the emission control transistor turns on in response to an emission control signal applied through an emission line so that a reference voltage lower than a high-potential voltage at the high-potential voltage terminal is applied to the first node to initialize the first node, and wherein the first transistor and the switching transistor are turned off during an initialization period by electrically decoupling the high-potential voltage terminal and the data line from the driver transistor.

2. The display device of claim 1, wherein a gate electrode of the first transistor and a gate electrode of the emission control transistor are connected to an emission control line, and the first transistor and the emission control transistor are turned on in response to an emission control signal transmitted through the emission control line, and wherein a gate electrode of the switching transistor and gate electrodes of the second and third transistors are connected to a scan line, and the switching transistor and the second and third transistors are turned on in response to a scan signal transmitted through the scan line.

3. The display device of claim 1, wherein a gate electrode of the first transistor is connected to an initialization line and turned on in response to an initialization signal transmitted through the initialization line, and a gate electrode of the switching transistor is connected to a scan line and turned on in response to a scan signal transmitted through the scan line.

4. The display device of claim 1, wherein a gate electrode of the first transistor is connected to an Nth emission control line and turned on in response to an Nth emission control signal transmitted through the Nth emission control line, a gate electrode of the emission control transistor is connected to an (N+1)th emission control line and turned on in response to an (N+1)th emission control signal transmitted through the (N+1)th emission control line, a gate electrode of the switching transistor is connected to an (N+1)th scan line and turned on in response to an (N+1)th scan signal transmitted through the (N+1)th scan line, and gate electrodes of the second and third transistors are connected to an Nth scan line and turned on in response to an Nth scan signal transmitted through the Nth scan line.

5. The display device of claim 1, wherein a drain electrode of the third transistor is connected to a reference voltage line configured to supply the reference voltage.

6. The display device of claim 1, further comprising a second capacitor connected between the first node and a gate electrode of the second transistor.

7. The display device of claim 1, wherein a voltage level of the reference voltage is set to be lower than a voltage difference between the high-potential voltage and a threshold voltage of the driver transistor.

8. The display device of claim 7, wherein a voltage difference between the reference voltage and a low-potential voltage is lower than the threshold voltage of the OLED.

9. A method of driving an organic light emitting diode (OLED) display device including a switching transistor, a driver transistor, an emission control transistor, a first transistor, a second transistor, a third transistor, a first capacitor, a second capacitor, and an OLED, the method comprising:

initializing, during an initialization period, a first node to which a gate electrode of the driver transistor is connected, by turning on the second transistor directly connected to a drain electrode of the driver transistor and the first node, the third transistor and the emission control transistor so that a reference voltage lower than a high-potential voltage at a high-potential voltage terminal is applied to the first node, and by turning off the first transistor and the switching transistor, to electrically decouple the high-potential voltage terminal and a data line from the driver transistor;

sensing a threshold voltage of the driver transistor, and transmitting a data voltage to the first node during turn-on operations of the switching transistor, the second transistor and the third transistor; and allowing the OLED to emit light during a turn-on operation of the emission control transistor, according to the driver transistor driving the OLED.

10. The method of claim 9, wherein the first transistor and the emission control transistor are turned on in response to an emission control signal transmitted through an emission control line, and the switching transistor and the second and third transistors are turned on in response to a scan signal transmitted through a scan line.

11. The method of claim 9, wherein the first transistor is turned on in response to an initialization signal transmitted through an initialization line, the emission control transistor is connected to an emission control line and turned on in response to an emission control signal transmitted through the emission control line, the switching transistor is turned on in response to a scan signal transmitted through a scan line, and the second and third transistors are turned on in response to a sensing signal transmitted through a sensing line.

12. The method of claim 9, wherein the first transistor is turned on in response to an Nth emission control signal transmitted through an Nth emission control line, the emission control transistor is turned on in response to an (N+1)th emission control signal transmitted through an (N+1)th emission control line, the switching transistor is turned on in response to an (N+1)th scan signal transmitted through an (N+1)th scan line, and the second and third transistors are turned on in response to an Nth scan signal transmitted through an Nth scan line.

13. The method of claim 9, the reference voltage is applied to the first node through the second transistor, the emission control transistor, and the third transistor.

14. An organic light emitting diode (OLED) display device comprising:

a substrate having a pixel; and an organic light emitting diode (OLED) on the substrate, wherein the pixel comprises:

a switching transistor connected to a scan line;

a driver transistor connected to a data line to drive the OLED;

an emission control transistor to control emission of the OLED;

first and second capacitors to store charges; and a first transistor, a second transistor, and a third transistor to transfer signals to the driver transistor, the second transistor directly connected to a drain electrode of the driver transistor and a first node, wherein the second transistor and the third transistor simultaneously turn on in response to a sensing signal applied through a sensing line and the emission control transistor turns on in response to an emission control signal applied through an emission line so that a reference voltage is applied to the first node to initialize the first node, and wherein the first transistor and the switching transistor are turned off during an initialization period by electrically decoupling a high-potential voltage terminal and the data line from the driver transistor.

15. The OLED display device of claim 14, wherein the pixel further cooperates with:

an initialization line to transfer an initialing signal to the first transistor;

the scan line to transfer a scan signal to the switching transistor; and a reference voltage line to transfer the reference voltage to the third transistor.

16. The OLED display device of claim 15, wherein each of said lines is used to individually control a turn on timing of each transistor.

17. The OLED display device of claim 14, wherein the first capacitor maintains a data voltage applied through the data line during one frame so that an amount of current flowing through the OLED can be maintained constant, and wherein the second capacitor stores a voltage difference between a gate electrode of the driver transistor and a gate electrode of the second transistor.

18. The OLED display device of claim 14, wherein the first transistor receives a high-potential voltage through the high-potential voltage terminal, and the switching transistor receives a data voltage through the data line.

19. The OLED display device of claim 14, wherein the driver transistor is configured to be turned off during the initialization period by cutting a supply of a high-potential voltage through the high-potential voltage terminal and a data voltage through the data line.

20. The OLED display device of claim 14, wherein turning off the driver transistor minimizes an initialization current flowing through a reference voltage line configured to supply the reference voltage.

21. The OLED display device of claim 14, wherein the reference voltage is applied to the first node through the second transistor, the emission control transistor, and the third transistor.

22. An apparatus comprising:

a pixel circuit comprising a six-transistor-two-capacitor (6T2C) structure including a switching transistor, a driver transistor, an emission control transistor, a first transistor, a second transistor, a third transistor, and a first node to which a gate electrode of the driver transistor is connected, during an initialization period, the second transistor directly connected to a drain electrode of the driver transistor and the first node, the emission control transistor and the second transistor and the third transistor to be simultaneously turned on so that a reference voltage lower than a high-potential voltage at a high-potential voltage terminal is applied to the first node to initialize the first node, and the switching transistor and the first transistor to be simultaneously turned off during the initialization period to reduce a current through the driver transistor by electrically decoupling the high-potential voltage terminal and a data line from the driver transistor.

23. The apparatus of claim 22, wherein:

said first transistor comprises its source connected to the high-potential voltage terminal to provide the high-potential voltage, its gate connected to an initialization line and its drain connected to a second node, said second transistor comprises its source connected to a third node, its gate connected to a sensing line, and its drain connected to the first node, and said third transistor comprises its source connected to a drain of said emission control transistor, its gate connected to said sensing line, and its drain connected to a reference voltage line.

24. The apparatus of claim 23, further comprising:

a first capacitor that maintains a data voltage from the data line during one frame such that an amount of current flowing through an emission device is held constant; and a second capacitor that stores a voltage difference between the gate electrode of the driver transistor and said gate of said second transistor.

25. The apparatus of claim 22, further comprising:

an initialization driver that applies initialization signals; and a sensing driver that applies sensing signals, said initialization driver and said sensing driver cooperating to allow said first through third transistors to be individually controlled via said initialization signals and said sensing signals.

26. The apparatus of claim 22, wherein said switching transistor and said first transistor remain in a turned off state during said initialization of said pixel circuit, such that a flow of overcurrent caused by an electrical short between the high-potential voltage from the high-potential voltage terminal and a data voltage from the data line is prevented.

27. The apparatus of claim 22, wherein a current flowing through an emission device is irrespective of a threshold voltage of said driver transistor, and said current is determined by the high-potential voltage from the high-potential voltage terminal and a data voltage from the data line.

* * * * *